US007424770B2

(12) United States Patent
Lyon

(10) Patent No.: US 7,424,770 B2
(45) Date of Patent: Sep. 16, 2008

(54) ATTACHMENT COMPRISING A FLEXIBLE CORD

(75) Inventor: Roy Lyon, The Old Stables, Grove Hill Road, Harrow, Middlesex (GB) HA1 3AA

(73) Assignees: Ian Lyon, Middlesex (GB); Roy Lyon, Middlesex (GB); Roger Lyon, Middlesex (GB)

( * ) Notice: Subject to any disclaimer, the term of this patent is extended or adjusted under 35 U.S.C. 154(b) by 26 days.

(21) Appl. No.: 10/510,603

(22) PCT Filed: Apr. 10, 2003

(86) PCT No.: PCT/GB03/01529

§ 371 (c)(1),
(2), (4) Date: Apr. 19, 2005

(87) PCT Pub. No.: WO03/088191

PCT Pub. Date: Oct. 23, 2003

(65) Prior Publication Data

US 2005/0199674 A1 Sep. 15, 2005

(30) Foreign Application Priority Data

Apr. 10, 2002 (GB) ..... 0208288.1

(51) Int. Cl.
*G09F 3/08* (2006.01)

(52) U.S. Cl. ..... 24/711.1; 40/662; 206/346

(58) Field of Classification Search ..... 24/711.1, 24/72.7, 711 A, 711.5, 704.1; 425/223, 122, 425/123, 126.1, 110, 116, 121; 264/35, 145, 264/157, 261, 297.2
See application file for complete search history.

(56) References Cited

U.S. PATENT DOCUMENTS

| | | | | | |
|---|---|---|---|---|---|
| 255,480 | A | * | 3/1882 | Webb | 24/298 |
| 2,131,372 | A | * | 9/1938 | Flood | 40/668 |
| 2,915,177 | A | * | 12/1959 | Flood | 206/460 |
| 3,103,666 | A | | 9/1963 | Bone | |
| 3,650,452 | A | | 3/1972 | Finke | |
| 3,977,050 | A | * | 8/1976 | Perez | 206/346 |
| 4,121,487 | A | | 10/1978 | Bone | |
| 4,456,161 | A | | 6/1984 | Russell | |
| 4,456,162 | A | | 6/1984 | Furutsu | |
| 4,554,711 | A | * | 11/1985 | Derringer | 206/346 |

(Continued)

FOREIGN PATENT DOCUMENTS

| | | |
|---|---|---|
| EP | 1 308 915 | 5/2003 |

(Continued)

*Primary Examiner*—Jack W. Lavinder
(74) *Attorney, Agent, or Firm*—Nixon & Vanderhye PC

(57) ABSTRACT

This invention relates to attachments (1) for attachment of a price tag, swing tag or security label to fabric or other articles. The attachment comprises a length of flexible cord (5) fixed to a plastic cross-bar (15) or T-shaped member at one end and a terminal member (10) at the other end. Also disclosed is a plurality of attachments connected to a spine, each attachment being independently severable from the spine by means of a tagging gun. Also disclosed are methods of making the attachments.

4 Claims, 9 Drawing Sheets

U.S. PATENT DOCUMENTS

Figure 1:
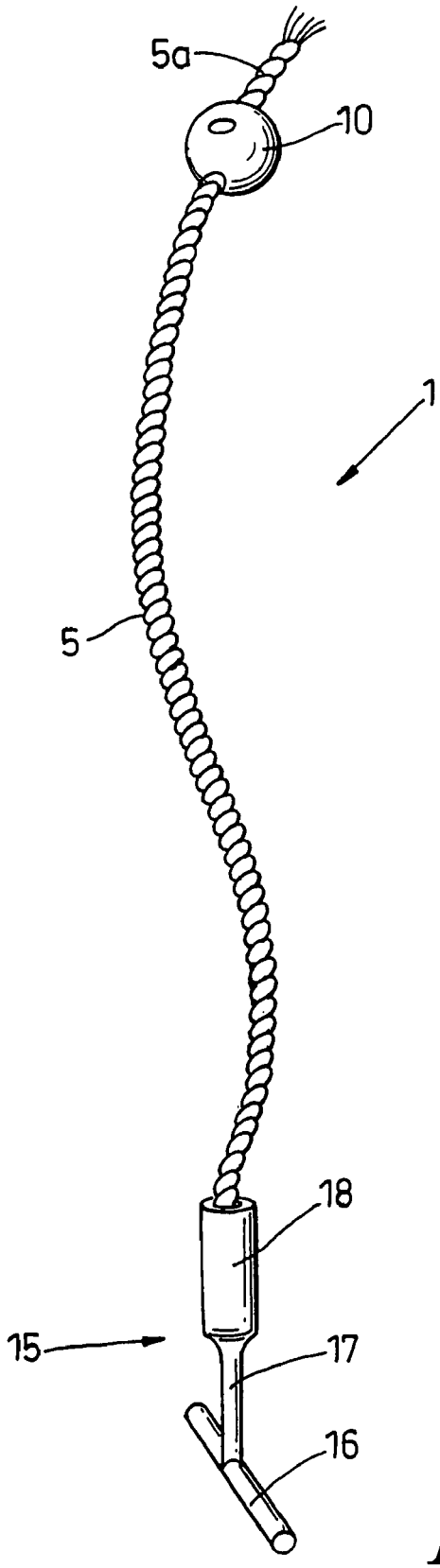

| | | | | | |
|---|---|---|---|---|---|
| 4,636,347 | A | * | 1/1987 | Kato | 264/251 |
| 5,024,365 | A | | 6/1991 | Bourque | |
| 5,320,269 | A | | 6/1994 | Deschenes et al. | |
| 5,321,872 | A | | 6/1994 | Merser | |
| 5,979,027 | A | | 11/1999 | Oh et al. | |
| 5,987,719 | A | | 11/1999 | Cooper | |
| 6,003,209 | A | | 12/1999 | Oh et al. | |
| 6,025,781 | A | | 2/2000 | Deschenes | |
| 6,062,384 | A | * | 5/2000 | Ueno et al. | 206/346 |
| 6,735,895 | B2 | * | 5/2004 | Wada et al. | 40/664 |
| 6,971,515 | B2 | | 12/2005 | Cooper | |

FOREIGN PATENT DOCUMENTS

| | | |
|---|---|---|
| GB | 1 110 233 | 4/1964 |
| GB | 1 184 545 | 5/1966 |
| GB | 1 375 447 | 11/1974 |
| GB | 2 143 782 | 2/1985 |
| GB | 2 376 978 | 12/2002 |

* cited by examiner

ATTACHMENT COMPRISING A FLEXIBLE CORD

This application is the US national phase of international application PCT/GB03/01529 filed 10 Apr. 2003, which designated the US. PCT/GB03/01529 claims priority to GB Application No. 0208288.1 filed 10 Apr. 2002. The entire contents of these applications are incorporated herein by reference.

This invention relates to attachments, in particular, although not exclusively, for attachment of a price tag, swing tag or security label to fabric or other articles.

Known attachments take the form of an elongate plastics filament having an integrally formed transverse cross-bar at one end, forming a T-shape with the filament, and an integrally formed paddle at the other. The attachment is typically used to secure a label or tag to a fabric article, clothing for example or a soft toy, the T-shaped end of the attachment being passed through a hole on the label or tag and the fabric, so that the filament extends through both. The paddle serves to prevent the label or tag from sliding off the other end of the filament. It is also known to secure such attachments to articles by passing the cross-bar through a pre-formed opening in the article, for example one of the lacing holes in a shoe or an opening formed specifically for the attachment.

The attachments are provided in an array, formed on a spine, to which their T-shaped ends are joined and are applied using a tagging gun. The tagging gun is adapted to receive the spine and the attachments it carries, and to 'fire' individual attachments, T-shaped end first, through the hole in the label or tag and the fabric, to secure one to the other.

Variations of these attachments are known in which the paddle is replaced by a hook by which the article can be suspended from a display, or an eye which might be used, for example, for the suspension of a further article. It is also known to provide cross-bars at both ends of the filament, especially when attaching two fabric articles together.

Another variation is for the paddle to be replaced with a snap-fit connector which allows connection of the attachment to a great variety of objects. All that is needed is that the object have a suitable formation with which the snap-fit connector on the filament can mate. Usually the snap-fit connector on the filament is in the form of a male connecting formation which can engage and be retained in a cooperating female formation of an object to which it is to be connected. Typically the snap-fit connector allows for connection of the attachment to a solid plastic label, which may bear a logo or trademark for example a fashion label. Advantageously the object can be connected to the attachment after the attachment itself has been "fired" into the fabric.

The above described attachments have an unattractive hard, synthetic appearance which can be off-putting to customers. When the attachment is attached to fabric, especially clothing; the plastic filament and paddle or other terminal member often stick out at an odd angle. Not only is this unaesthetic, it can also cause difficulties if tagged fabric articles are stacked for storage as the attachments can scratch and potentially damage adjacent articles. Furthermore when a customer in a shop tries on an item of clothing tagged with one of the attachments, the attachment can often cause discomfort and create a negative impression of the clothing.

Consequently many retailers have started using attachments in which a cotton loop is tied around a label and attached to clothing with a safety pin. However these attachments, although aesthetically pleasing, are time consuming as they have to be fixed to the clothing by hand.

Accordingly, a first aspect of the present invention provides an attachment intended to be secured to an article by a tagging gun, the attachment comprising: a flexible cord formed from several fibre strands which have been twisted together; a cross-shaped member or a T-shaped member, said cross-shaped or T-shaped member having a plastic cross bar and down bar; and a terminal member, wherein at one end of the flexible cord, the flexible cord is fixed to the down bar of the cross-shaped or T-shaped member, said terminal member being fixed to the other end of the flexible cord.

The cord may be formed of rayon, cotton, hemp, elastic or any other suitable material. Preferably the cord is formed of a different material to the plastic cross-shaped or T-shaped member. The cord may be formed of a natural material. The cord may be formed of natural material. The cord is preferably formed of a material which has a higher melting point than the plastic cross-bar and terminal member of the attachment; this enables the cross shaped or T-shaped member and terminal member to be moulded around the cord.

The flexible cord of the above type has several advantages over the elongate plastic filament used in prior art attachments. The cord is softer than a plastic filament and this causes less discomfort to a customer trying on the clothing. It also has a superior appearance and its colour and texture can easily be matched to the fabric article to which the attachment is applied. The cord is more flexible than a plastic filament and is generally "limp", that is it does not have a resilient tendency to return to an initial position; it therefore lies more naturally with an article to which it is applied. For example a label supported by an attachment having a flexible cord will hang more naturally than an attachment having a plastic filament. Furthermore an attachment having the above type of cord is less likely to cause irritation to a customer trying on a garment bearing the attachment, especially if the cord has low resilience and/or high flexibility and/or is composed of a soft material.

The cord is usually formed of a material which is more flexible and/or softer than the material of the plastic cross-shaped or T-shaped member to which it is fixed.

The terminal member is preferably made of plastic. It may be a paddle, ball or other configuration which serves to prevent a label or tag from sliding off the end of the cord. Alternatively it could be a hook by which the attachment and article to which it is attached may be suspended, or an eye which could be threaded onto a support member of a display, a second cross-shaped or T-shaped member so that the attachment can be used to attach two fabric articles together, or a snap-fit connector, as described above.

Preferably the cord is fixed to the cross-shaped or T-shaped member by moulding of the cross-shaped or T-shaped member around the cord. This provides a neat, strong connection between the cross-shaped or T-shaped member and the cord. The cord does not need to extend all the way through and generally extends only part way into the cross-shaped or T-shaped member. Preferably the cord does not extend as far as the cross part (i.e. the junction between cross-bar and down-bar of the cross-shaped member or T-shaped member. Preferably one end of the cross-shaped or T-shaped member is provided with an enlarged flange and it is this enlarged flange, but not the rest of the cross-shaped or T-shaped member, which is moulded around the cord. The enlarged flange may have any shape, for example, it may be cylindrical or spherical. In many cases the cord will have a larger cross sectional area than cross-shaped or T-shaped member, but a smaller cross sectional area than the enlarged flange. However, if the cord has a small enough cross-sectional area it may pass all the way through the cross-shaped or T-shaped member and out the other end (if this is the case then the enlarged flange is unnecessary).

Preferably the terminal member is similarly moulded around the cord. The cord may extend all the way through or only partially into the terminal member.

According to a second aspect of the invention there is provided an assembly comprising a plurality of attachments, each attachment comprising: a flexible cord formed from several fibre strands which have been twisted together; a cross-shaped member or a T-shaped member, said cross-shaped or T-shaped member having a plastic cross bar and down bar; and a terminal member, wherein, at one end of the flexible cord, the flexible cord is fixed to the down bar of the cross-shaped or T-shaped member, said terminal member being fixed to the other end of the flexible cord, said assembly further comprising a common spine, each of said attachment being releasably attached to said common spine via said cross-shaped member of said T-shaped member, each attachment being independently severable from said common spine by means of a tagging gun.

This allows the attachments to be attached to articles, such as clothing, by use of a conventional tagging gun.

Preferably intermediate teeth are provided on the spine in between the attachments. This aids operation of the tagging gun.

The second aspect of the invention may include any of the above mentioned features of the first aspect of the invention.

A third aspect of the present invention provides a method for making an attachment, the attachment comprising: a flexible cord; a cross-shaped member or a T-shaped member; and a terminal member, wherein, at one end of the flexible cord, the flexible cord is fixed to the cross-shaped or T-shaped member, said terminal member being fixed to the other end of the flexible cord, the method comprising the steps:

a) providing a mould with a first recess for moulding a cross-shaped or T-shaped member and a second recess for moulding said terminal member;

b) placing said flexible cord in the mould so that it extends between and passes at least partially into said recesses;

c) injecting liquid plastics material into said recesses and allowing it to solidify.

Preferably the first recess is shaped to form the cross-shaped or T-shaped member with an enlarged flange and in step b) the cord is placed so that it extends into the flange forming portion of said recess but not further into said recess. Generally the cord will have a cross sectional area such that it can fit into the enlarged flange portion of the recess, but not into the rest of the recess which has a smaller cross sectional area.

Surplus cord may then be cut off.

Preferably the cord is cut at or just below the terminal member or cross-shaped or T-shaped member so as to separate the rest of the cord from the attachment formed by the cross-shaped or T-shaped member, terminal member and length of cord therebetween. The rest of the cord may then be drawn through the mould so as to put it in the position described in step b) so that a new attachment can be formed; step c) can then be repeated and so on, so as to make a plurality of attachments.

Preferably the mould is opened after step c) so as to allow drawing of the cord and attachment through the mould into position for forming a new attachment.

The mould has more than two parts so that parts of the mould can be closed to clamp the cord into position, while parts of the mould remain open to allow the cord to be cut prior to moulding the new attachment. Preferably the cord is cut at the point at which it passes through or out of the enlarged flange section of the cross-shaped or T-shaped member recess, so that the cord will extend into the enlarged flange portion of the new cross-bar or T-shaped member, but no further. In one embodiment the mould has five parts.

Preferably the cross-shaped or T-shaped member is formed with one of its bars extending substantially perpendicular to the parting plane of the mould.

In a preferred embodiment the above method is adapted to make an assembly of attachments according to the second aspect of the invention. Preferably this is achieved by providing the mould with a recess for moulding a spine and a plurality of cross-shaped or T-shaped members attached to the spine and a plurality of recesses for moulding terminal members.

The cross-bar and spine recess thus has several cross-shaped or T-shaped member portions, each respective cross-shaped or T-shaped member portion of the recess is preferably positioned opposite a corresponding terminal member recess.

A plurality of cords can then be introduced, each cord being positioned between a terminal member recess and a respective cross-shaped or T-shaped member portion of the spine and cross-shaped or T-shaped member recess. Each cord may be stored on a respective reel and fed into the mould as required. The terminal member recesses may each have their own liquid plastic injection ports, or alternatively they can be in fluid communication, e.g. via a recess for moulding a connecting runner which can be snapped of f the assembly to leave the final product. The cords can be pulled through the mould together, once the attachments and spine have been moulded, for example, by pulling the spine or a connecting runner between the moulded terminal members. Additional apparatus may be provided to grip a portion of the attachment, spine or connecting runner and automatically pull the completed attachments from the mould whilst also pulling new lengths of cord into the mould for subsequent moulding.

In alternative embodiments, a single cord can be positioned so that it extends back and forth between the terminal member recesses and cross-shaped or T-shaped member portions of the spine and cross-shaped or T-shaped member recess and at least partially into said recesses. Then once the liquid plastic has been injected and solidified, the surplus connecting pieces of cord can be cut to separate the attachments if necessary.

In this alternative the mould preferably has cord support means, such as pins, at least one of which is positioned or positionable adjacent the cross-shaped or T-shaped member recesses and at least another of which is positioned or positionable adjacent or preferably behind the terminal, member recesses. By "behind" it is meant that the terminal member recesses are between the spine and cross-shaped or T-shaped member recess and the cord support means "behind" them. The flexible cord can then be passed between the cord support means (e.g. by winding or looping around cord support pins) so that it extends back and forth between the cross-shaped or T-shaped member and terminal member recesses.

So, for example the cord may pass from a first cross-bar recess, across the mould, to a first terminal member recess, then back across the mould to a second cross-shaped or T-shaped member recess etc. Alternatively, the cord may pass between two adjacent cross-shaped or T-shaped member recesses before passing back across the mould to the terminal member recesses and pass between two adjacent terminal member recesses before passing back across the mould again.

In this way, the cord passes through or enters partially into the recesses, so that when the liquid plastic is injected into and solidifies in the recesses, the cord is fixed to the terminal members and the cross-bars or T-shaped members. The cord may then be cut so as to separate any terminal members which have been connected together by the cord and so as to sever any cord connection between adjacent cross-shaped or T-shaped members. The cord is thus cut into several lengths each length connecting a respective terminal member and cross-shaped or T-shaped member and an assembly according to the second aspect of the invention is formed.

The cord support means may be fixed in position. Alternatively at least some of the cord support means may be movable between a first position and a second position. This provides a useful technique for positioning the cord in the desired position as it can be laid on the mould in a straight line and adjusted by movement of the cord support means.

In one embodiment a first set of cord support means is permanently fixed in position adjacent the spine and cross-shaped or T-shaped member recess and a second set of cord support means is slidable in the mould between a first position adjacent the spine and cross-shaped or T-shaped member recess and a second position adjacent the terminal member recesses. The flexible cord is laid on the mould such that it extends between the two sets of cord support means and the second set is then moved to the second position so that parts of the cord are kept adjacent the spine and cross-shaped or T-shaped member recess by the first set of support means and parts of the cord are pulled toward the terminal member recesses by the second set of support means, the cord thus extending back and forth between the recesses as desired.

The method of the third aspect of the invention may be used to make an attachment or assembly having any of the features described above in relation to the first and second aspects of the invention.

A fourth aspect of the invention provides apparatus for making an assembly comprising a plurality of attachments, each attachment comprising: a flexible cord; a cross-shaped member or a T-shaped member; and a terminal member, wherein, at one end of the flexible cord, the flexible cord is fixed to the cross-shaped or T-shaped member, said terminal member being fixed to the other end of the flexible cord, said assembly further comprising a common spine, each of said attachments being releasably attached to said common spine via said cross-shaped member or said T-shaped member, each attachment being independently severable from said common spine by means of a tagging gun, said apparatus comprising a mould having: a first recess for moulding said common spine and said cross-shaped or T-shaped members; second recesses for moulding said terminal members; and cord support means for supporting a cord that extends between and at least partially into said first and second recesses, wherein said first recess includes enlarged flange portions for surrounding the cord.

Further preferred features of the above aspects of the invention may be found in the claims.

Embodiments of the invention will now be described in detail, with reference to the accompanying drawings, in which:-

Figures 2A, 2B, 2C:
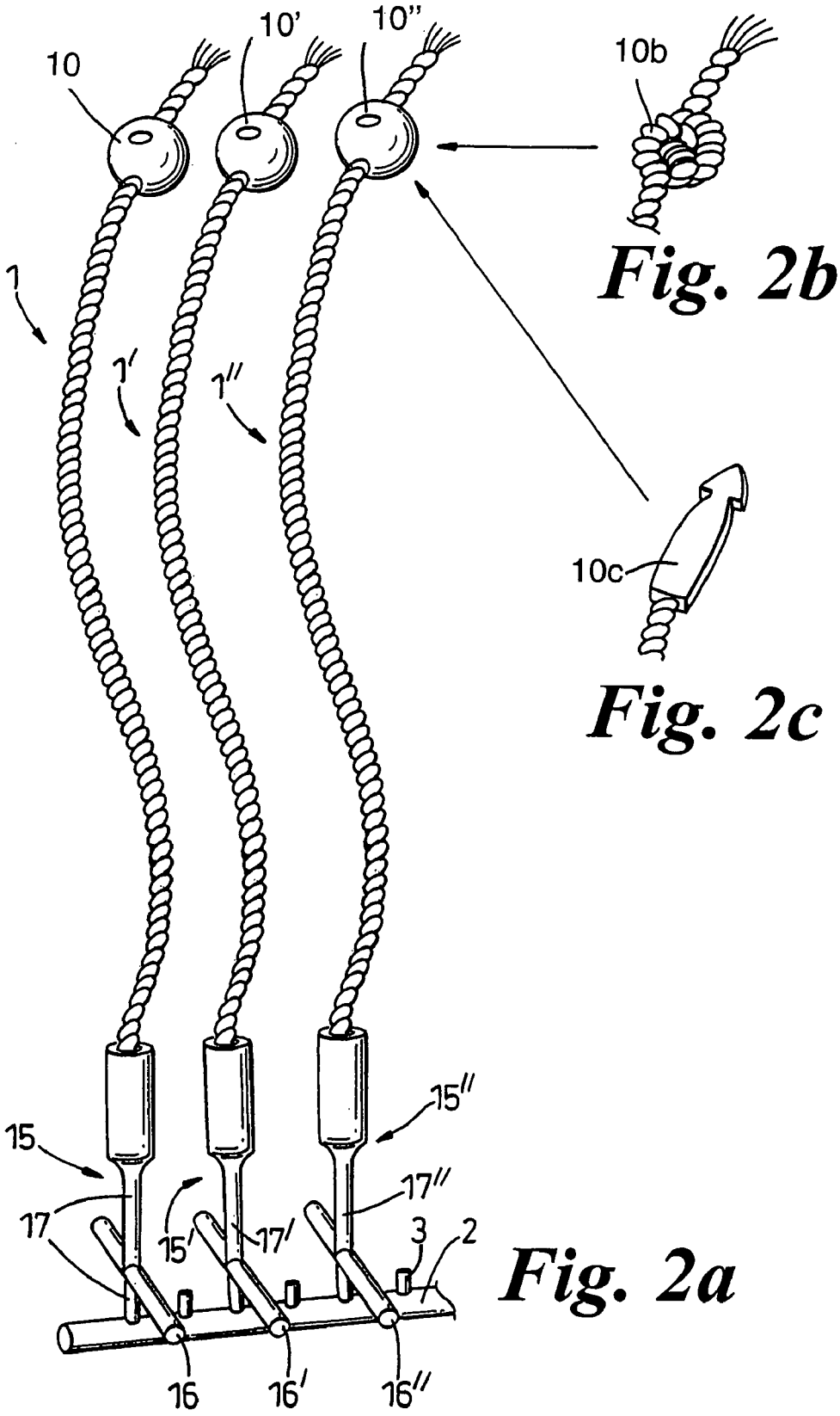

FIG. 1 shows an attachment having a flexible cord;

FIG. 2*a* shows an assembly comprising a plurality of attachments mounted on a spine; and FIGS. 2*b* and 2*c* show alternative terminal members;

FIGS. 3*a*-3*f* show steps in a first method for the manufacture of an assembly such as that shown in FIG. 2*a;*

Figure 4A:
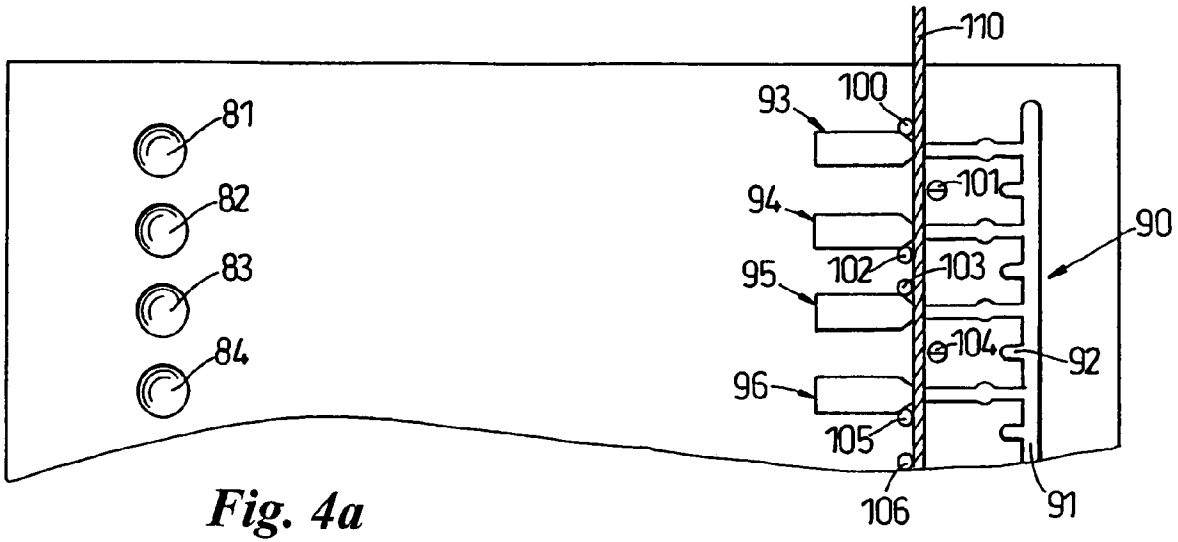
Figure 4B:
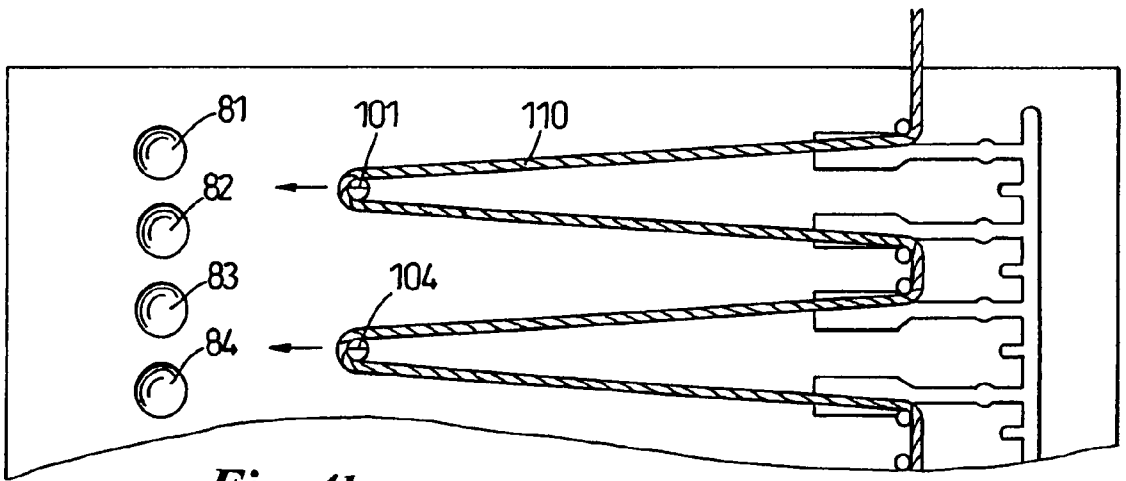
Figure 4C:
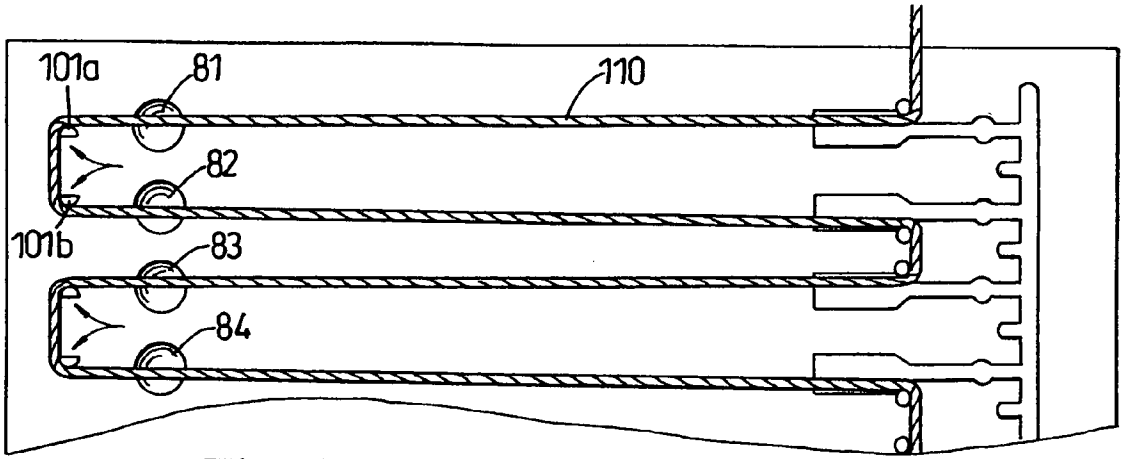
Figure 4D:
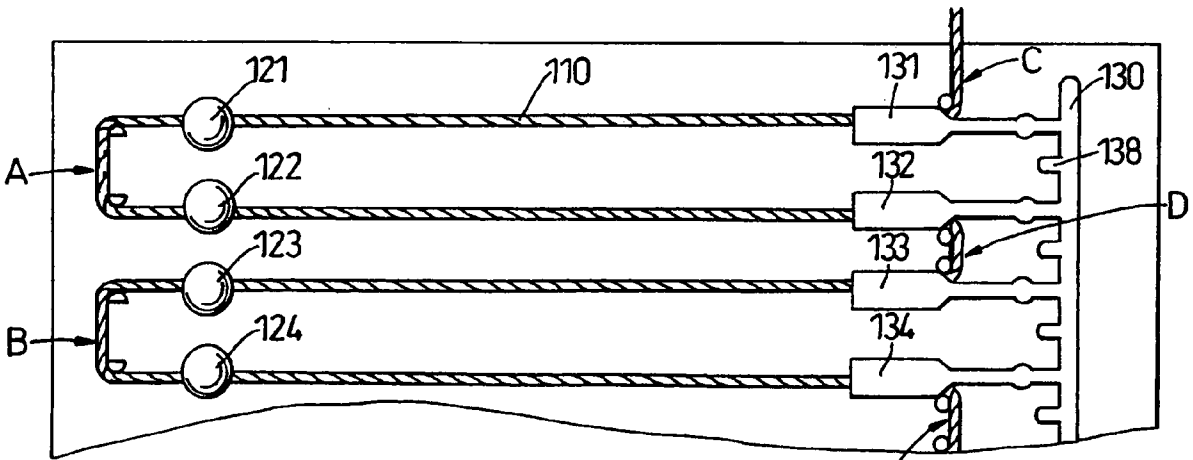
Figure 4E:
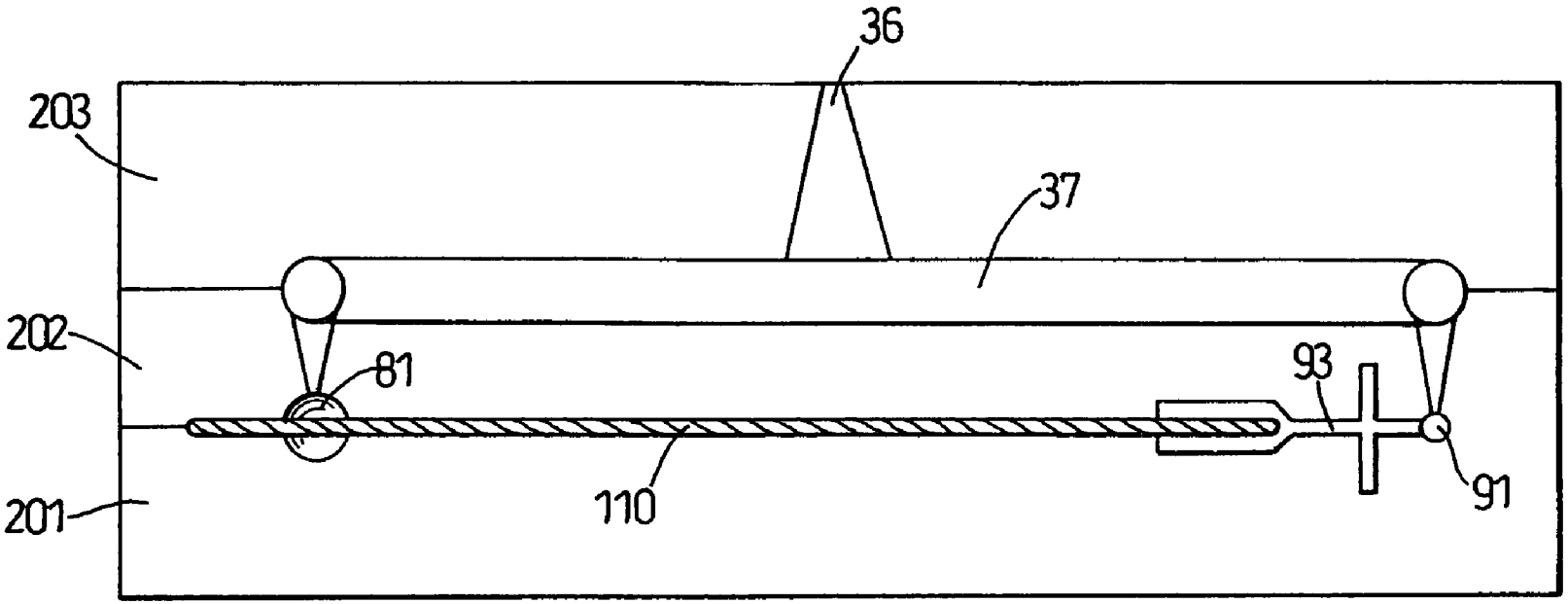
Figure 5:
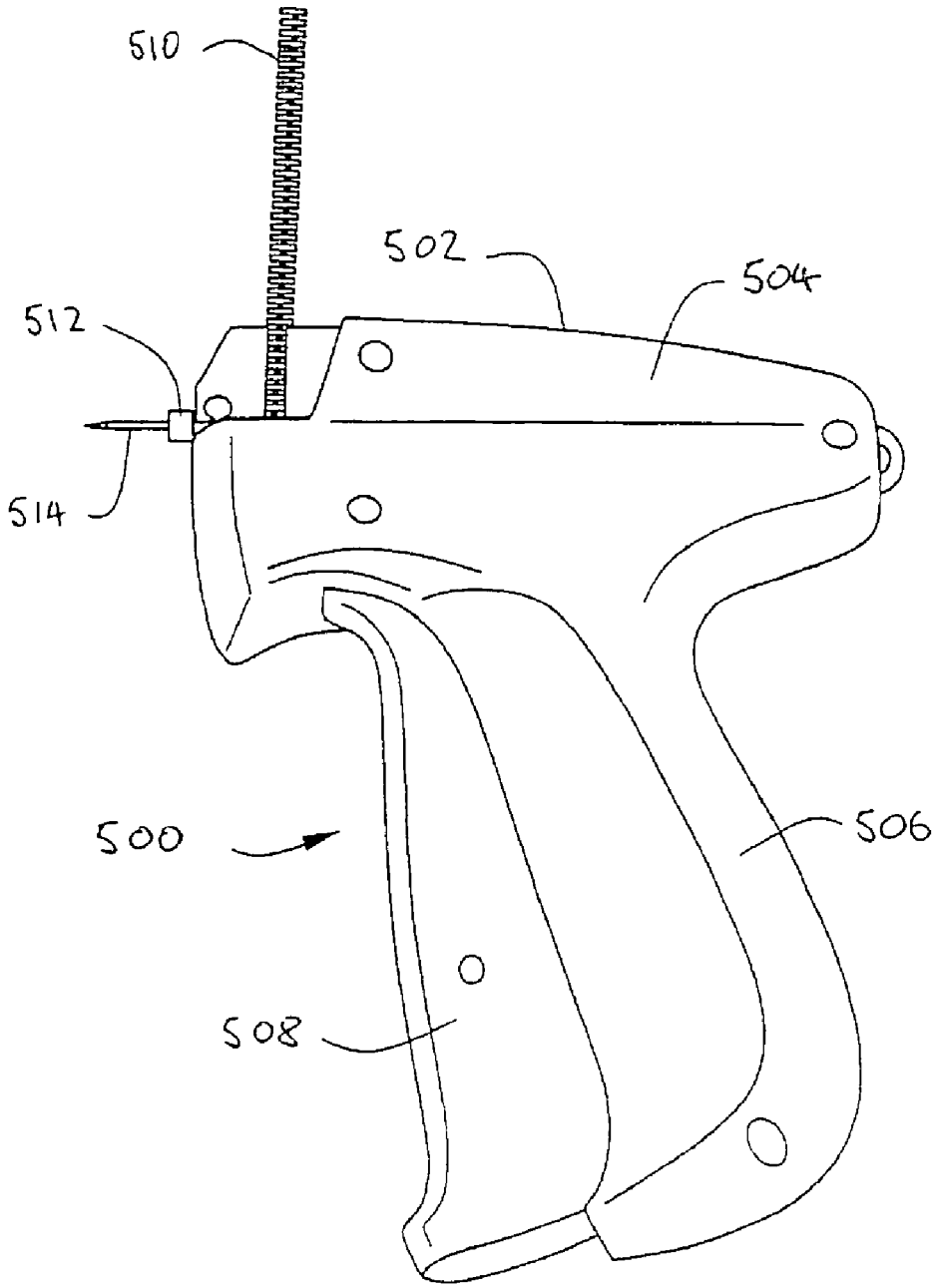
FIGURE 5 Prior Art

FIGS. 4*a*-4*e* show steps in a second method for the manufacture of an assembly such as that shown in FIG. 2*a*; and FIG. 5 shows a prior art tagging gun which may be used to secure an attachment according to the invention to an article.

An embodiment of the first aspect of the invention is the attachment shown in FIG. 1, designed for attachment to a fabric article or articles. The attachment 1 comprises a length of flexible cord 5, one end of which is fixed to a terminal member 10 in the form of a moulded plastic ball and the other end of which is fixed to a moulded plastic T-shaped member 15. The T-shaped member 15 comprises two bars 16 and 17 which are substantially perpendicular to each other; one bar 17 of the bars is longer than the other (bar 16) and has an enlarged flange 18 at one end to which the flexible cord 5 is fixed. The cord 5 is thicker than the bar 17 (i.e. it has a larger cross sectional area), but thinner than the enlarged flange 18. In this embodiment the cord extends through the terminal member such that a short length 5*a* extends out of the end of the terminal member; in other embodiments the cord extends only partially into the terminal member.

The flexible cord 5 is formed from several fibre strands which have been twisted together to form a string. Compared to the T-shaped member 15 the cord 5 is flexible and soft. It is also relatively limp and capable of adopting various configurations without resiliently returning to an original (e.g. straight) configuration. This has the advantage that the attachment hangs naturally from fabric articles, such as clothing, to which it is attached and is unlikely to irritate a customer trying on the clothing.

The terminal member 10 and T-shaped member 15 may be formed of any suitable plastic, e.g. nylon; the flexible cord 5 may be formed of any suitable material, e.g. rayon.

FIG. 2*a* shows a portion of a second embodiment of the second aspect of the invention: an assembly comprising a elongate cylindrical plastic spine on which a plurality of attachments 1, 1', 1" are mounted. FIG. 2*a* shows only an end portion of the assembly, the spine may have more than three attachments mounted on it. Each attachment is similar to the attachment shown in FIG. 1. The T-shaped members are releasably attached to the spine 2, such that the attachments may be severed from the spine by use of a tagging gun as is conventionally known in the art. Intermediate teeth 3 are provided on the spine, between the attachments, to assist operation of the tagging gun.

FIG. 2*b* shows an alternative terminal member 10*b*, in the form of plastic, such as nylon, moulded to give the appearance of a knot. FIG. 2*c* shows a further alternative terminal member 10*c*: an arrow-shaped snap-fit connector. Similarly the terminal member 10 could equally well be a paddle, hook, eye, snap fit connector, cross-bar, or T-shaped member, instead of a ball.

A first method of manufacturing the attachment assembly of FIG. 2*a* will now be described with reference to FIGS. 3*a*-3*f*.

A five part mould is used. The mould 20 comprises a first part 21 opposing a second part 22, a third part 23 opposing a fourth part 24 and a parting plane between the first 23. and second 22 and third 23 and fourth 24 parts as shown in FIG. 3*d*. When these mould parts are closed, they define a recess for moulding a plurality of cross-bars attached to a spine and a plurality of recesses for moulding ball shaped terminal members. There is also an upper, fifth part 25 of the mould which in use overlies the first and third parts 21, 23 and is described in more detail below. The mould is shown in cross section in FIGS. 3*a*-3*e*. The cross section cuts perpendicular to the axis of the spine and so only a first recess 35 for moulding a T-shaped member and a second recess 40 for moulding a ball shaped terminal member 10 can be seen in FIGS. 3*a*-3*e*, however other recesses exist as shown in FIG. 3*f* which is a partial cross-section of the mould 20 along the line A-A of FIG. 3*a*, before the liquid plastic is injected. FIG. 3*f* shows cross-bar recesses 35*a*-35*d* and terminal member recesses 40*a*-40*d*. The cross-bar recesses are joined by the spine recess 36 which runs perpendicular to the plane of the cross-section of FIGS. 3*a*-3*e*. The spine recess 36 is shaped for moulding a plurality of teeth 52 so that the assembly when formed can be used with a tagging gun. The fifth part 25 of the mould has an injection port 365 for supplying liquid nylon to the recesses via a channel 37. The channel 37 connects to the back end of the flange portion 135 of the cross-bar recess 35.

A flexible cord 30 (e.g. a rayon string cord) is placed in the mould such that it extends between the first and second recesses 35, 40. The cord 30 extends through or at least partially into each recess; this is important as it allows the plastic T-shaped member and terminal portions to be moulded around the cord 30, providing a simple, neat way of fixing the T-shaped member and terminal portion to the cord. The channel 37 connects to the back of the flange portion 135 of the T-shaped member recess 35. Thus the speed and pressure of the injected plastic ensures that the cord is kept correctly positioned in the recess 35 to ensure that the plastic is moulded around the cord.

The cord 30 extends into the T-shaped member recess 35, only as far as the enlarged flange portion 135 thereof, it does not extend as far as the cross part 139. Separate rayon string cords are likewise placed between the other terminal member and T-shaped member recesses (see FIG. 3*f*).

Figure 3A:
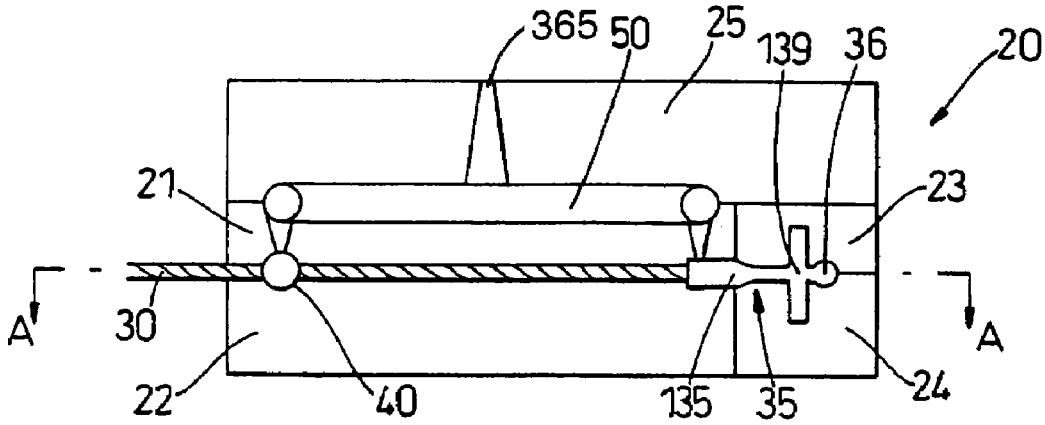
Figure 3B:
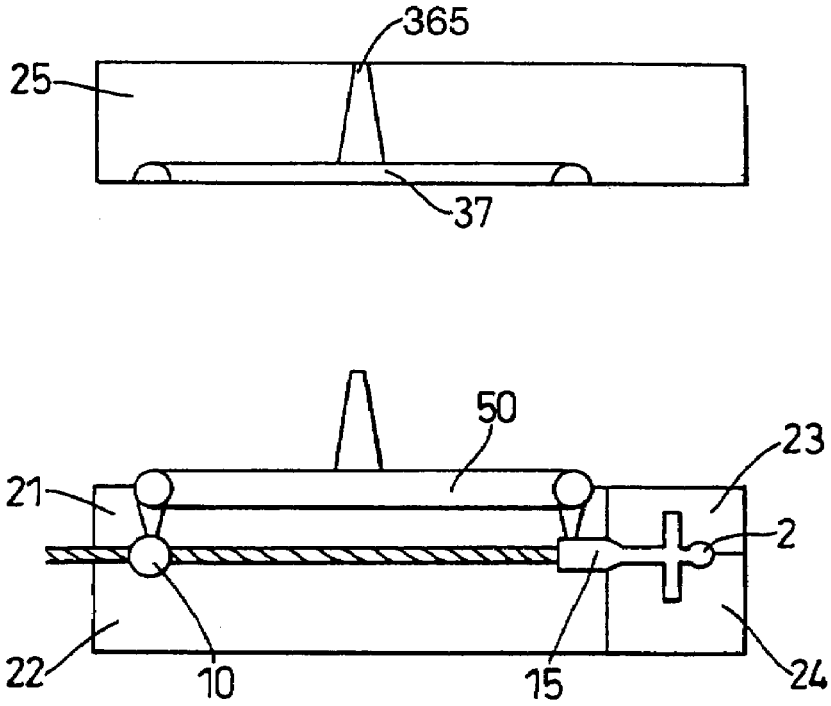
Figure 3C:
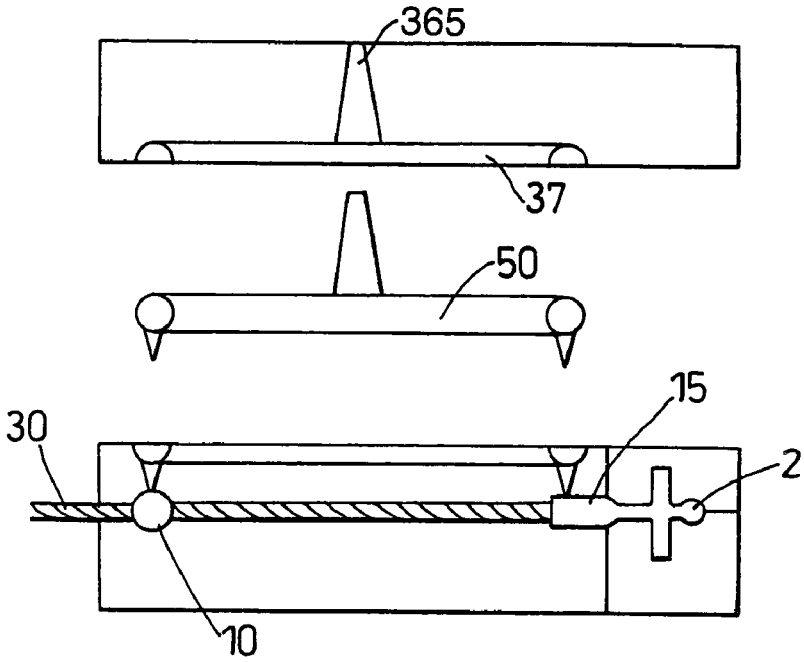
Figure 3D:
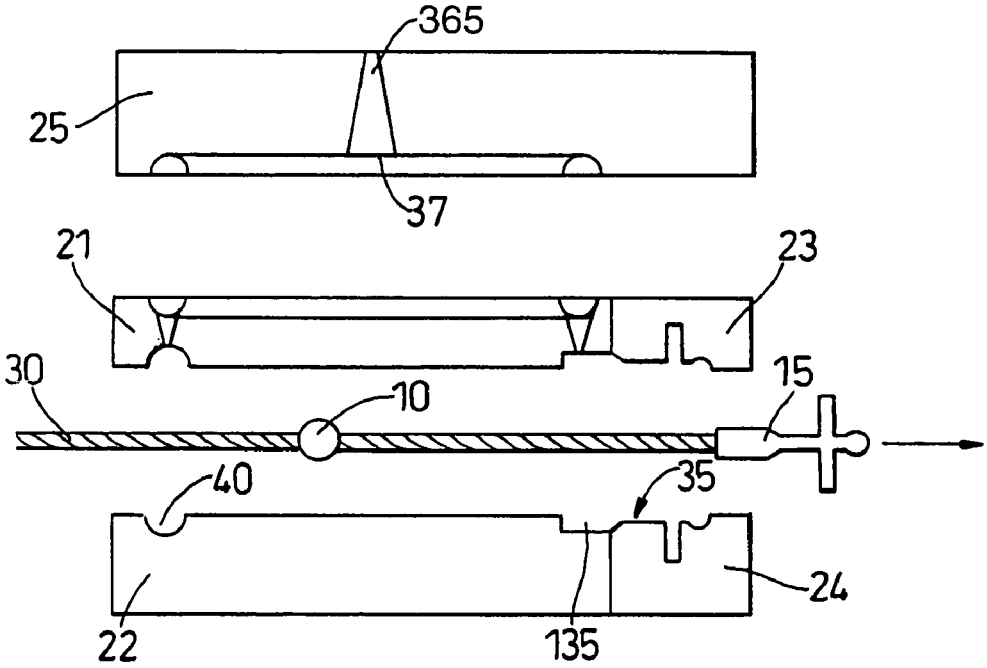

In FIGS. 3*a* and 3*b* the nylon has already been injected through the injection port 36 of the closed mould 20 and allowed to solidify so as to form the T-shaped member 15 and the ball shaped terminal member 10. The T-shaped member and terminal member have been moulded around the cord 30 and are therefore securely fixed to it. The same is true of the other cords and T-shaped member and terminal member recesses (shown in the Fig 3*f* cross section). All the T-shaped members are connected by the moulded spine 2 to which they are attached. The liquid plastic also solidifies in the channel 37 to form a connecting runner 50 which can be snapped or cut off as shown in FIG. 3*c* once the fifth mould part 25 has been opened.

Figure 3E:
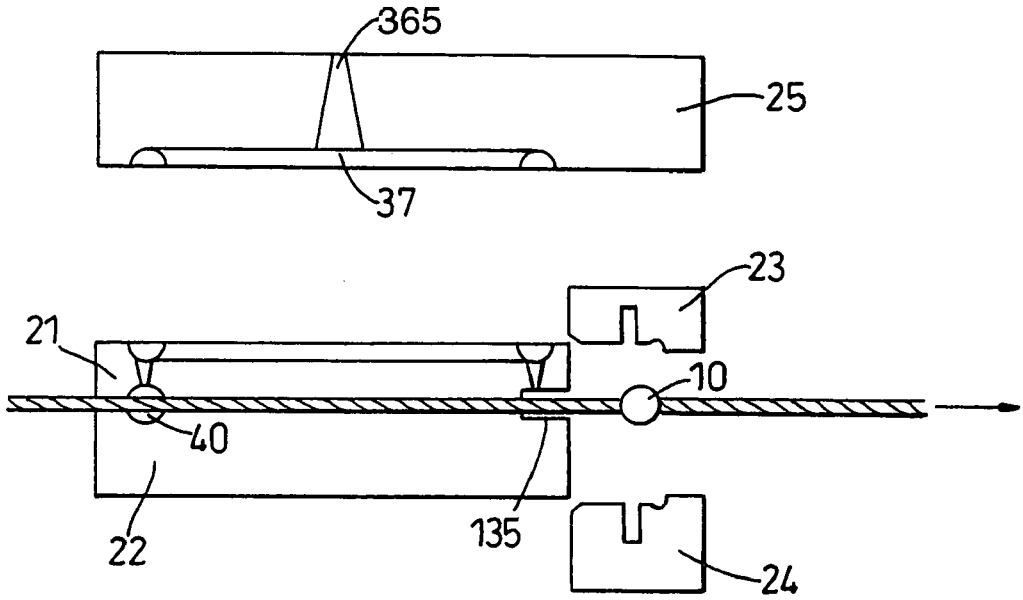
Figure 3F:
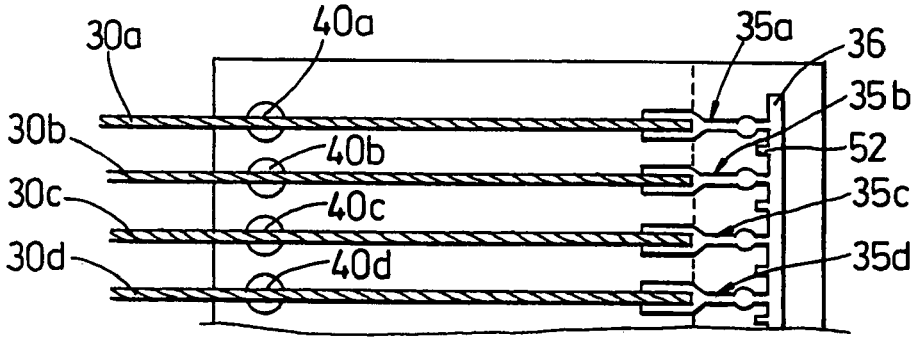

Once the nylon has solidified and the T-shaped members 15, and terminal members 10 and spine 2 have been formed, and the runner so removed, the mould parts 21-24 are opened by separating the parts 21, 22, 23, 24 along their common parting plane, as shown in FIG. 3*d*. 20 The cord 30 is then pulled along in the direction from the terminal member recess to the T-shaped member recess (the left to right direction in FIG. 3*d*), until the terminal member 10, which has just been formed, is positioned between the third 23 and fourth 24 mould parts as shown in FIG. 3*e*. The cord 30 attached to the terminal member 15 is thus pulled through the mould, so that it is in position for forming a new attachment. The other cords and terminal members are likewise pulled through the mould, in fact all can easily be pulled through at once, to the desired position, as they are all connected via their respective T-shaped members to the spine 2.

The first 21 and second 22 mould parts are then closed so as to grip the cord 30 (and the other cords shown in FIG. 3*f*), but the third 23 and fourth 24 mould parts are left open as shown in FIG. 3*e*, so that the cords may easily be cut. The cord 30, then extends back from the terminal portion 10 through the mould parts 21 and 22, through the enlarged flange portion 135 of the T-shaped member recess and through the terminal portion recess 40. The cord 30 is then cut just below the terminal portion 10, at the point where it leaves the enlarged flange recess 135, to separate the attachment (i.e. the terminal portion 10, T-shaped member 15 and the length of cord therebetween) which has just been formed, from the rest of the cord 30. The other cords (shown in FIG. 3*f*) are likewise cut. The mould parts 23 and 24 are then closed and liquid nylon is again injected and allowed to solidify to form new attachments and a new spine. The process can be repeated as many times as necessary to make the required number of attachments assemblies.

A second method of making an assembly such as that shown in FIG. 2*a* will now be described with reference to FIGS. 4*a*-4*e*.

A second method of making an assembly such as that shown in FIG. 2*a* will now be described with reference to FIGS. 4*a*-4*e*.

A partial cross-sectional plan view of the mould along a central parting plane of the mould is shown in FIGS. 4*a*-4*e*. The mould has a plurality of generally spherical recesses 81, 82, 83, 84 for moulding ball shaped terminal members and a recess 90 for moulding a spine and a plurality of T-shaped members releasably attached to the spine. The recess 90 has a spine recess portion 91, intermediate teeth recess portions 92 and T-shared member recess portions 93-96. The mould is designed to form a spine having four attachments, although in alternative embodiments larger moulds capable of forming ten or more attachments could be used. The necessary modifications will be apparent to a person skilled in the art.

The terminal member recesses 81-84 are provided towards one end of the mould and the spine and cross-bar recess 90 is provided towards an opposite end of the mould. The T-shaped member recess portions of the recess 90 extend towards the terminal member recesses 81-84.

The pins can be divided into a first set, comprising pins 100, 102, 103, 105 and 106 and a second set comprising pins 101, 102, 103, 105 and 106 and a second set comprising pins 101 and 104. In the starting configuration shown in a FIG. 4*a*, the pins in the first set are aligned with each other along a line substantially parallel to the spine portion 91 of the recess 90. The pins in the second set 101 and 104 are also aligned with each other along a line substantially parallel to the spine portion 91 of the recess 90. The pins in the first set are fixed in place near the ends of the T-shaped member recess portions 93, 94, 95 and 96 of the recess 90. The pins in the second set are slidable from a first position adjacent the T-shaped member recess portions 93-96 and closer to the spine recess 91 than the pins in the first set, to a second position behind the terminal member recesses 81-84, as shown in FIG. 4*c* (FIG. 4*b* shows an intermediate position as the pins are being slid between their first and second positions).

In the starting configuration, shown in FIG. 4*a*, the pins in the first set are fixed in place near the T-shaped member portions of the recess 90 and the pins in the second set 101 and 104 are in their first position adjacent the T-shaped member recess portions. In general there is either one pin from the second set, or two pins from the first set between each pair of T-shaped member recess portions of the recess 90. A flexible cord 110 is fed into the mould so that it extends between the pins of the first and second sets and in a straight line approximately parallel to the spine portion 91 of the recess 90.

The pins in the second set 101 and 104 (which may be mounted in grooves in the mould) are then slid to their second position, adjacent the terminal member recesses as shown in FIG. 4*c*. The arrows in FIG. 4*b* show the direction of movement of the pins.

The pin 101 has two parts 101*a* and 101*b* which separate in the second position to be behind terminal portion recesses 81 and 82 respectively. The pin 104 also has two parts 104*a* and 104*b* which separate in its second position to fall behind terminal member recesses 83 and 84 respectively. The pin parts 101*a*, 101*b*, 104*a* and 104*b* are then temporarily locked into their second positions, shown in FIG. 4*c*.

Liquid plastic is then injected into the terminal member 81-84 recesses and the recesses 90, through an injection port (which is not shown in FIGS. 4*a*-4*d*). The plastic is allowed to solidify so as to form terminal members 121-124 and a spine 130 with releasably attached T-shaped members 131-234 and intermediate teeth 138 disposed between the cross-bars as shown in FIG. 4*d*. As should be evident, the spine 130, T-shaped members 131-134 and intermediate teeth 138 are integrally formed. The connection formed by an extension bar between each T-shaped member and the spine being weak enough that it can be cut or severed by a tagging gun. The liquid plastic is injected through a third mould part 203 having an injection port 365 and channel 37 for delivering the liquid plastic to the recesses in the first 201 and second 202 mould parts; the channel contacts (is in fluid communication with) the spine portion 91 of the T-shaped member and spine recess 90. As in the first method, plastic which solidifies in the channel 37 can be removed.

Surplus pieces of cord and lengths of cord connecting the attachments can then be cut. Thus surplus cord is cut at locations C and E adjacent the outermost T-shaped members and unwanted cord connections are cut at locations A and B in the region of the pins 101 and 104 between adjacent terminal members and at location D between two of the T-shaped member portions 132 and 133 which have two cord supporting pins 102 and 103 between them.

FIG. 5 shows a prior art tagging gun known from U.S. Pat. No. 6,971,515 (FIG. 9), the disclosure of which is incorporated herein by this reference. Tagging gun 500 has a gun-shaped casing 502 with a barrel portion 504, a handle portion 506 and trigger 508. A clip 510 of attachments is fed into the tagging gun 500. Needle adapter 512 is provided in order to attach hollow slotted needle 514 to the tagging gun.

The skilled man will appreciate that alterations to and variations of the above embodiments are possible while still keeping within the scope of the appended claims.

The invention claimed is:

1. An assembly comprising a plurality of attachments releasably attached to a common spine and intended to be secured to an article by a tagging gun, each attachment comprising:

a limp flexible cord formed from several fibre strands which have been twisted together, the cord being without resilient tendency to return to an initial position;

a cross-shaped member or a T-shaped member, said cross-shaped or T-shaped member having a plastic cross bar and down bar, the down bar having a first section extending from the cross bar and a second section comprising an enlarged flange, the enlarged flange being moulded around one end of the flexible cord; and a terminal member moulded at the other end of the flexible cord, wherein each of said attachments is releasably attached to said common spine by an extension bar extending from the common spine to said cross bar so that each attachment is independently severable from said common spine, and wherein the diameter of the cord is greater than that of the first section of the down bar, but smaller than that of the enlarged flange.

2. An assembly according to claim 1 wherein the cord is formed of a natural material.

3. An assembly according to claim 2 wherein the cord is formed of cotton.

4. An assembly according to claim 1 further comprising teeth on the common spine, between the attachments.

* * * * *